US008577523B2

(12) United States Patent
Zanfei

(10) Patent No.: US 8,577,523 B2
(45) Date of Patent: Nov. 5, 2013

(54) METHOD FOR VERIFYING THE TOE ANGLE OF A SHIP'S RUDDERS

(75) Inventor: Adriano Zanfei, Madrano (IT)

(73) Assignee: ZF Friedrichshafen AG, Friedrichshafen (DE)

( * ) Notice: Subject to any disclaimer, the term of this patent is extended or adjusted under 35 U.S.C. 154(b) by 154 days.

(21) Appl. No.: 13/258,672

(22) PCT Filed: Mar. 30, 2010

(86) PCT No.: PCT/EP2010/054149

§ 371 (c)(1),
(2), (4) Date: Sep. 22, 2011

(87) PCT Pub. No.: WO2010/112480

PCT Pub. Date: Oct. 7, 2010

(65) Prior Publication Data

US 2012/0016543 A1 Jan. 19, 2012

(30) Foreign Application Priority Data

Apr. 1, 2009 (DE) ..... 10 2009 002 109

(51) Int. Cl.

| | |
|---|---|
| ***B60L 3/00*** | (2006.01) |
| ***B60L 15/00*** | (2006.01) |
| ***G05D 1/00*** | (2006.01) |
| ***G05D 3/00*** | (2006.01) |
| ***G06F 7/00*** | (2006.01) |
| ***G06F 17/00*** | (2006.01) |

(52) U.S. Cl.
USPC ..... 701/21; 114/144 RE; 114/162

(58) Field of Classification Search
USPC ..... 701/110, 21, 23, 42, 500, 99; 114/122, 114/144 A, 144 C, 144 E, 144 R, 144 RE, 114/145 A, 150, 162, 163, 165, 167, 246, 114/61.13, 61.29, 67 A; 244/230; 318/568.22, 588, 635; 440/1, 43, 51, 440/53, 6, 61 A, 69; 73/114.53
See application file for complete search history.

(56) References Cited

U.S. PATENT DOCUMENTS

| | | | | |
|---|---|---|---|---|
| 3,899,987 | A | 8/1975 | Wright et al. | |
| 4,223,624 | A * | 9/1980 | Iyeta | 114/144 E |
| 4,380,206 | A | 4/1983 | Baitis et al. | |
| 5,415,122 | A * | 5/1995 | Shen | 114/162 |
| 5,488,919 | A * | 2/1996 | Ferreiro et al. | 114/122 |
| 6,886,485 | B2 | 5/2005 | Tomita et al. | |
| 7,006,905 | B2 * | 2/2006 | Hamamatsu et al. | 701/21 |
| 2002/0014194 | A1 * | 2/2002 | McKenney et al. | 114/144 R |
| 2006/0278152 | A1 * | 12/2006 | Nickerson | 114/144 R |
| 2011/0028057 | A1 | 2/2011 | Torrangs et al. | |

FOREIGN PATENT DOCUMENTS

| | | | |
|---|---|---|---|
| EP | 1 394 037 | A1 | 3/2004 |
| WO | 2008/030149 | A1 | 3/2008 |

* cited by examiner

*Primary Examiner* — Thomas Black
*Assistant Examiner* — Isaac Smith
(74) *Attorney, Agent, or Firm* — Davis & Bujold, PLLC; Michael J. Bujold

(57) ABSTRACT

A method of checking a toe angle of at least one port rudder (1) and at least one starboard rudder (2) of a ship, which are electronically adjusted via a control device, such that different toe angles are set for the at least one port rudder (1) and the at least one starboard rudder (2) and from which an optimal toe angle is determined, in real time, for each of the at least one port rudder (1) and the at least one starboard rudder (2).

11 Claims, 1 Drawing Sheet

METHOD FOR VERIFYING THE TOE ANGLE OF A SHIP'S RUDDERS

This application is a National Stage completion of PCT/EP2010/054149 filed Mar. 30, 2010, which claims priority from German patent application serial no. 10 2009 002 109.4 filed Apr. 1, 2009.

FIELD OF THE INVENTION

The present invention concerns a method for checking the toe angle of a ship's rudder.

BACKGROUND OF THE INVENTION

Known propulsion systems for ships are, for example, inboard and outboard transmission systems. An inboard transmission system includes an engine arranged in the hull. A drive shaft is connected to the engine through a reduction gear, with the drive shaft passing through the ship's hull and featuring a drivable propeller at its end for propulsion of the ship. The propeller directs its flow towards the rudder. For realization of desired maneuvers, the rudder is controlled by a steering arrangement, with several rudders normally being provided, for example, relative to the longitudinal axis of the ship, a starboard-arranged rudder, and a port rudder.

Furthermore, an electronic steering mechanism arrangement for the ship's rudder is known as a steer-by-wire system. This system involves replacement of mechanical or hydraulic connections between the steering wheel and the rudders with an electronic control device and a suitable network for transmitting the corresponding signals. The electronic control device receives signals from a sensor which detects the steering-wheel position and converts them into output signals for triggering the electric actuator of each rudder and setting of a steering angle. For example, two inboard transmission systems that are arranged on a starboard rudder and a port rudder of the ship can be used.

It has been shown that when a ship is driving straight ahead, the toe angle of both rudders or their relative position to one another considerably influences the resistance to flow. With known control devices, a multitude of test runs is required in order to determine manually a toe angle in relation to the characteristic parameters of each ship. It is not possible to continually check when these known arrangements are used.

SUMMARY OF THE INVENTION

The underlying task of this patent is, therefore, to propose a method for checking the toe angle of the rudders of a ship, which can then be used to check continually and automatically the toe angle in order to minimize the resistance to flow.

Accordingly, a method for checking a toe angle of at least one starboard rudder and of at least one port rudder of a ship has been proposed, with the rudders electronically adjusted via a control device. According to the invention, the different toe angles of the rudders are adjusted gradually so that an optimal toe angle is determined in real time from these gradually determined toe angles of each rudder.

In this way, with the help of the proposed method, a minimum resistance to flow can be continually and specifically determined for each ship depending on the hull shape and other parameters, thus increasing the maximum speed for the respective ship and, at the same time, minimizing mechanical stresses that have an impact on the control system. A special benefit is derived from the fact that the method proposed by the invention is partially automated so that, for example, changing environmental conditions are taken into account automatically in determining the optimal toe angle.

As part of a preferred design variation in the present invention, it can be arranged for the rudders to be adjusted gradually in the opposite direction when the ship is being steered straight ahead, for example, whereby for each adjusted toe angle, the required energy consumption of a dedicated electric actuator for maintaining the adjusted positions of each rudder is determined so that the toe angle is assigned the lowest energy consumption and is stored as the optimal toe angle for the dedicated rudder. Depending on which toe angle is determined as the optimal toe angle in conjunction with the ship's parameters and the environmental parameters, a toe-in or a toe-out can be adjusted on the rudders of a ship. For each toe angle checked, the applied strength of current (amperage) is then measured, which current intensity is needed to hold the rudder in the predetermined steering position and resist a flow torque adjacent to the rudder caused by the hydrodynamic forces; the measured value then determining the necessary energy consumption in the actuators. Each strength of current adjusted on the engines is therefore a measure for the forces occurring or for the resistance to flow. In this way, the optimal toe angle can be determined, at which the resistance to flow achieves its minimum.

As part of the checking method, the setting angle of each rudder can be set in any preferred angular range of +/−3°. But other angular ranges are also possible. The rudder can be controlled by means of the central control device that is connected to the respective rudder control unit via a vehicle network, the CAN bus, for example. The data and signals determined while using the checking method proposed in the invention can be transmitted, via the vehicle network, to the control device for analysis.

Preferably, the checking method can be automatically started if the ship is moving at a constant speed, for example, when driving straight ahead. This ensures that a constant flow torque caused by hydrodynamic forces is present on the rudders.

Another configuration of the present invention can provide for an automatic or manual start by the operator for the proposed method during the initialization phase. Preferably, a speed of 10 knots should not be exceeded while the checking procedure is being performed. Otherwise, the procedure is automatically interrupted.

According to a further embodiment of the invention, the method can ensure that the checking process is canceled if the steering wheel is rotated more than +/−1°. This way, the driver can cancel or interrupt the proposed checking process at any time, if needed. This can prevent safety-critical situations.

BRIEF DESCRIPTION OF THE DRAWINGS

The invention is further explained below with the help of drawings: Shown here.

DETAILED DESCRIPTION OF THE PREFERRED EMBODIMENTS

Figure 1:
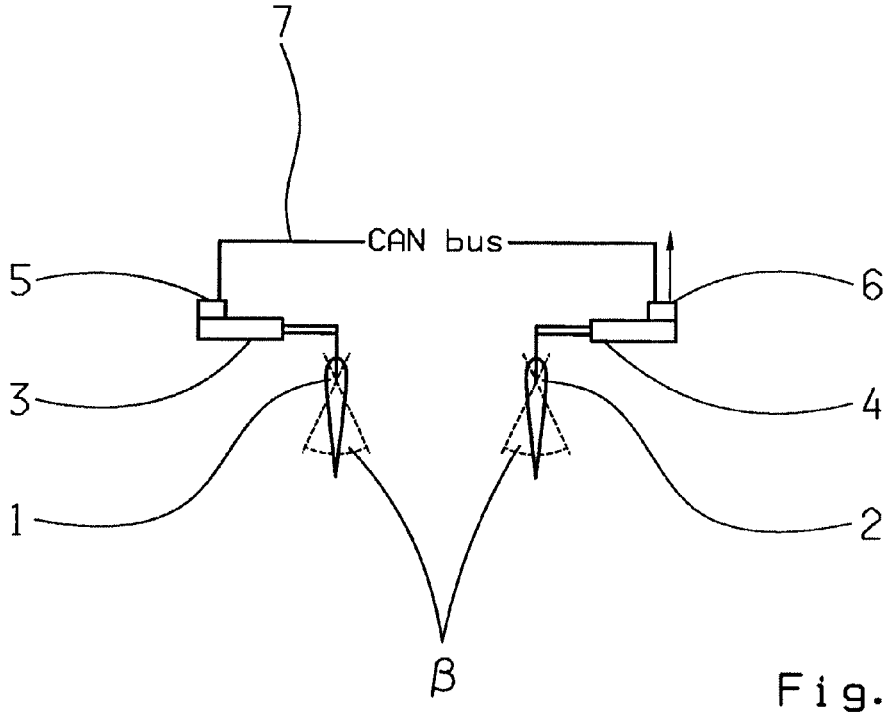
FIG. 1 a schematic partial view of an electronic control system for steering a ship.

FIG. 1 shows rudder 1 arranged on the starboard side and rudder 2 on the port side, which are both controlled via an electronic control device that is indicated by the arrow symbol. Each rudder 1, 2 indicates an electric actuator 3, 4 and a dedicated motor drive 5, 6 for rudder control in order to adjust the specified control angle or the toe angle.

Both engine inputs 5, 6 are connected with one another and to the control device for signal or data transmission via a bus system 7. On each rudder 1, 2 a dotted line indicates the possible setting angle β which is gradually traversed in carrying out the method proposed in the patent in order to determine the hydrodynamic forces acting at each set toe angle and to evaluate the selected toe angle in the respective driving condition of the ship.

Figure 2:
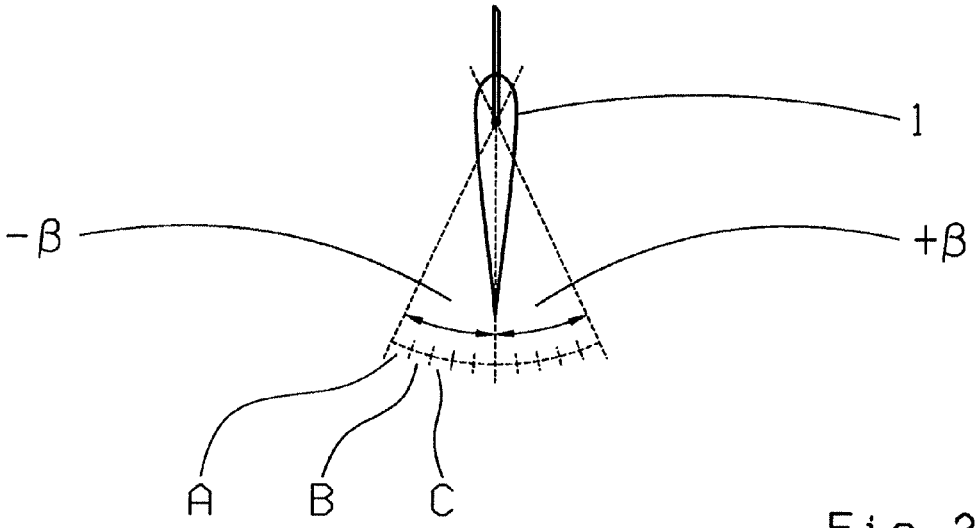
FIG. 2 a detailed view of a rudder with a suggested angular range for gradually adjusting the rudder as part of the proposed method for checking a toe angle.

FIG. 2 is an enlarged view of one of the rudders 1. This view demonstrates that the setting angle β is divided up into a predetermined number of setting steps A, B, C . . . Starting with the steering angle of 0°, each rudder 1, 2 can be adjusted in any steering direction e.g. by β=+3° or by =−3°. In this manner, a toe-in or even a toe-out can be adjusted as a toe angle, depending on which toe angle was identified as optimal.

As an example, in FIG. 2, the setting angle 13 is divided into five individual steps A, B, C, . . . starting in any direction from the steering angle 0°.

When gradually setting the different steering angles, the required energy consumption of the rudder's dedicated electric actuator is calculated over a predetermined time, e.g. 30 seconds in order to consequently obtain a measurement for the hydrodynamic forces occurring at the different steering angles or toe angles. After traversing the range of the setting angles, data and signals transmitted to the control device via the vehicle network 7 can be analyzed in order to determine the setting angle with the lowest energy consumption. Afterwards, the optimal toe angle can be saved accordingly. The optimal toe angle can also be shown on a display for the driver.

REFERENCE MARKS

1 Port rudder
2 Starboard rudder
3 Rudder actuator
4 Rudder actuator
5 Engine input
6 Engine input
7 Network
β Setting angle
A,B,C Setting step

The invention claimed is:

1. A method of verifying a toe angle of at least one port rudder (1) and at least one starboard rudder (2) of a ship which are both electronically adjustable via a control device, the method comprising the steps of:

measuring a toe angle, for each of the at least one port rudder (1) and the at least one starboard rudder (2), as a deviation from a 0° steering angle, determining a required energy consumption of a dedicated electric actuator of each of the at least one port rudder (1) and the at least one starboard rudder (2) over a predetermined time, during which time each respective toe angle of the rudders (1, 2) is discretely and incrementally adjusted over a range of angles deviating from the 0° steering angle to obtain a measurement of hydrodynamic forces occurring at each of the incremental toe angles such that a real time determination of a toe angle, having a lowest energy consumption, is enabled, and defining an optimal toe angle for each of the at least one port rudder (1) and the at least one starboard rudder (2) as the toe angle having the lowest energy consumption.

2. The method according to claim 1, further comprising the step of the incrementally adjusting the at least one port rudder (1) and the at least one starboard rudder (2) in opposite directions, when the ship is driving straight ahead, and determining for each incremental toe angle, a necessary energy consumption of a dedicated electric actuator (3, 4) for maintaining a position of each of the of the at least one port rudder (1) and the at least one starboard rudder (2) associated with each respective incremental toe angle so that the toe angle having the lowest energy consumption is stored as the optimal toe angle for each of the rudders (1, 2).

3. The method according to claim 2, further comprising the step of determining and showing the optimal toe angle on a display.

4. The method according to claim 1, further comprising the steps of defining a setting angle (β) as an angle of deviation from the 0° steering angle in both a positive direction and a negative direction, which then defines an angular range in which the toe angles are incrementally adjusted and associated energy consumption measured, and using 3° as the setting angle (β) for each of the at least one port rudder (1) and the at least one starboard rudder (2).

5. The method according to claim 1, further comprising the step of deactivating the method upon rotation of a steering wheel by more than a 1° deviation from the 0° steering angle in either a positive or negative direction.

6. The method according to claim 1, further comprising the step of deactivating the method if a speed of the ship exceeds 10 knots.

7. The method according to claim 1, further comprising the step of activating and deactivating the method one of manually and automatically.

8. The method according to claim 4, further comprising the step of dividing the setting angle (β) into at least five discrete steps and incrementally adjusting the toe angle to each of the at least five discrete steps, and measuring the associated energy consumption for each of the at least five discrete steps to determination of the toe angle having the lowest energy consumption.

9. The method according to claim 4, further comprising the step of arranging the at least one port rudder (1) and the at least one starboard rudder (2) to be within 6 degrees of parallel to one another.

10. The method according to claim 4, further comprising the step of arranging the at least one port rudder (1) and the at least one starboard rudder (2) to be substantially parallel to one another.

11. A method of verifying a toe angle of at least one port rudder (1) and at least one starboard rudder (2) of a ship which are both electronically adjustable via a control device, the method comprising the steps of:

arranging each of the at least one port rudder (1) and each of the at least one starboard rudder (2) parallel to one another, measuring a toe angle, for each of the at least one port rudder (1) and the at least one starboard rudder (2), as a deviation from a 0° steering angle of each respective rudder for at least five incrementally adjusted discrete steps, and measuring the associated energy consumption for each of the at least five incrementally adjusted discrete steps to determination of the toe angle having the lowest energy consumption, determining a required energy consumption of a dedicated electric actuator of each of the at least one port rudder (1) and the at least one starboard rudder (2) over a predetermined time, during which time each respective toe angle of the rudders (1, 2) is discretely and incrementally adjusted over a range of angles, deviating from the 0° steering angle, to obtain a measurement of hydrodynamic forces occurring at each one of the incremental toe angles such that a real time determination of a toe angle, having a lowest energy consumption, is determined, and defining an optimal toe angle, for each of the at least one port rudder (1) and the at least one starboard rudder (2), as the toe angle having the lowest energy consumption.

* * * * *